US011282664B2

(12) United States Patent
Clark et al.

(10) Patent No.: US 11,282,664 B2
(45) Date of Patent: Mar. 22, 2022

(54) HANDLE MECHANISMS FOR CIRCUIT BREAKERS AND RELATED SYSTEMS AND METHODS

(71) Applicant: Eaton Intelligent Power Limited, Dublin (IE)

(72) Inventors: John Clark, Beaver, PA (US); Ramesh Powar, Kolhapur (IN); Sujit Patwardhan, Pune (IN)

(73) Assignee: Eaton Intelligent Power Limited, Dublin (IE)

( * ) Notice: Subject to any disclaimer, the term of this patent is extended or adjusted under 35 U.S.C. 154(b) by 473 days.

(21) Appl. No.: 16/410,349

(22) Filed: May 13, 2019

(65) Prior Publication Data

US 2020/0365357 A1 Nov. 19, 2020

(51) Int. Cl.
*H01H 71/56* (2006.01)
*H01H 71/02* (2006.01)

(52) U.S. Cl.
CPC ..... *H01H 71/56* (2013.01); *H01H 71/0207* (2013.01); *H01H 2071/565* (2013.01); *H01H 2239/03* (2013.01)

(58) Field of Classification Search
CPC ..... H01H 71/56; H01H 71/0207; H01H 2071/565; H01H 2239/03; H01H 19/04; H01H 19/08; H01H 19/14; H01H 3/08; H01H 71/46
USPC ..... 200/293, 329–331, 336
See application file for complete search history.

(56) References Cited

U.S. PATENT DOCUMENTS 5,493,084 A * 2/1996 Whitaker ..... H01H 3/10 200/50.05
5,821,487 A * 10/1998 Groves ..... H01H 9/282 200/50.02
7,399,934 B2 * 7/2008 Emura ..... H01H 71/56 200/50.12
10,319,541 B1 6/2019 Clark et al.

FOREIGN PATENT DOCUMENTS

EP 2500925 3/2014

* cited by examiner

*Primary Examiner* — Edwin A. Leon
(74) *Attorney, Agent, or Firm* — Myers Bigel, P.A.

(57) ABSTRACT

A circuit breaker assembly includes a circuit breaker including a housing and a handle extending from the housing, with the handle being movable between an on position and an off position. The assembly includes a handle mechanism connected to the housing of the circuit breaker. The handle mechanism includes a base, a slider slidably connected to the base and including first and second spaced apart arms with the handle of the circuit breaker at least partially between the first and second arms, and a spring on the slider. The slider is movable between a first position with the handle in the on position and a second position with the handle in the off position. The handle engages the spring with the handle in the on position and the slider in the first position.

20 Claims, 7 Drawing Sheets

HANDLE MECHANISMS FOR CIRCUIT BREAKERS AND RELATED SYSTEMS AND METHODS

BACKGROUND

In certain applications, it is necessary for a circuit breaker to be situated in an enclosure such as a National Electrical Manufacturers Association (NEMA) box. Circuit breakers typically have a handle that is movable between an on position and an off or tripped position, and switching the circuit breaker between those positions can be more difficult if the circuit breaker is situated in the enclosure.

SUMMARY

Some embodiments of the present invention are directed to a circuit breaker assembly. The assembly includes a circuit breaker including a housing and a handle extending from the housing, with the handle being movable between an on position and an off position. The assembly includes a handle mechanism connected to the housing of the circuit breaker. The handle mechanism includes a base, a slider slidably connected to the base and including first and second spaced apart arms with the handle of the circuit breaker at least partially between the first and second arms, and a spring on the slider. The slider is movable between a first position with the handle in the on position and a second position with the handle in the off position. The handle engages the spring with the handle in the on position and the slider in the first position.

Some other embodiments of the present invention are directed to a method. The method includes providing a circuit breaker system. The circuit breaker system includes a circuit breaker including a housing and a handle extending from the housing, with the handle being movable between an on position and an off position. The circuit breaker system includes a handle mechanism connected to the housing of the circuit breaker and including a bracket including a base, a slider on the base and including first and second spaced apart arms with the handle at least partially received between the arms, and a spring on the slider extending between the first and second arms. The slider is slidable along the base between a first position with the handle in the on position and a second position with the handle in the off position. The method includes receiving the handle against the spring with the slider in the first position and the handle in the on position. The method includes, using the spring, transmitting a force to the handle of the circuit breaker in a direction that is substantially coaxial to or substantially parallel to a longitudinal axis of the handle so as to prevent the slider from inadvertently moving from the first position to the second position.

Some other embodiments of the present invention are directed to a circuit breaker system including an enclosure. The system includes a circuit breaker held in the enclosure, with the circuit breaker including a housing and a handle extending from the housing, and with the handle movable between an on position and an off position. The system includes a handle mechanism connected to the housing of the circuit breaker. The handle mechanism includes a bracket comprising a base, a crank assembly on the base, a slider including first and second spaced apart arms with the handle of the circuit breaker at least partially between the first and second arms, and a spring on the slider. The slider is connected to the base and is operatively connected to the crank assembly, and is configured to slide between a first position with the handle in the on position and a second position with the handle in the off position. The system includes a rotary handle on the enclosure and a shaft extending between the crank assembly and the rotary handle. The slider is configured to move between the first position and the second position in response to rotation of the rotary handle between a first orientation and a second orientation. The handle engages the spring with the handle in the on position and the slider in the first position.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION

Figure 1:
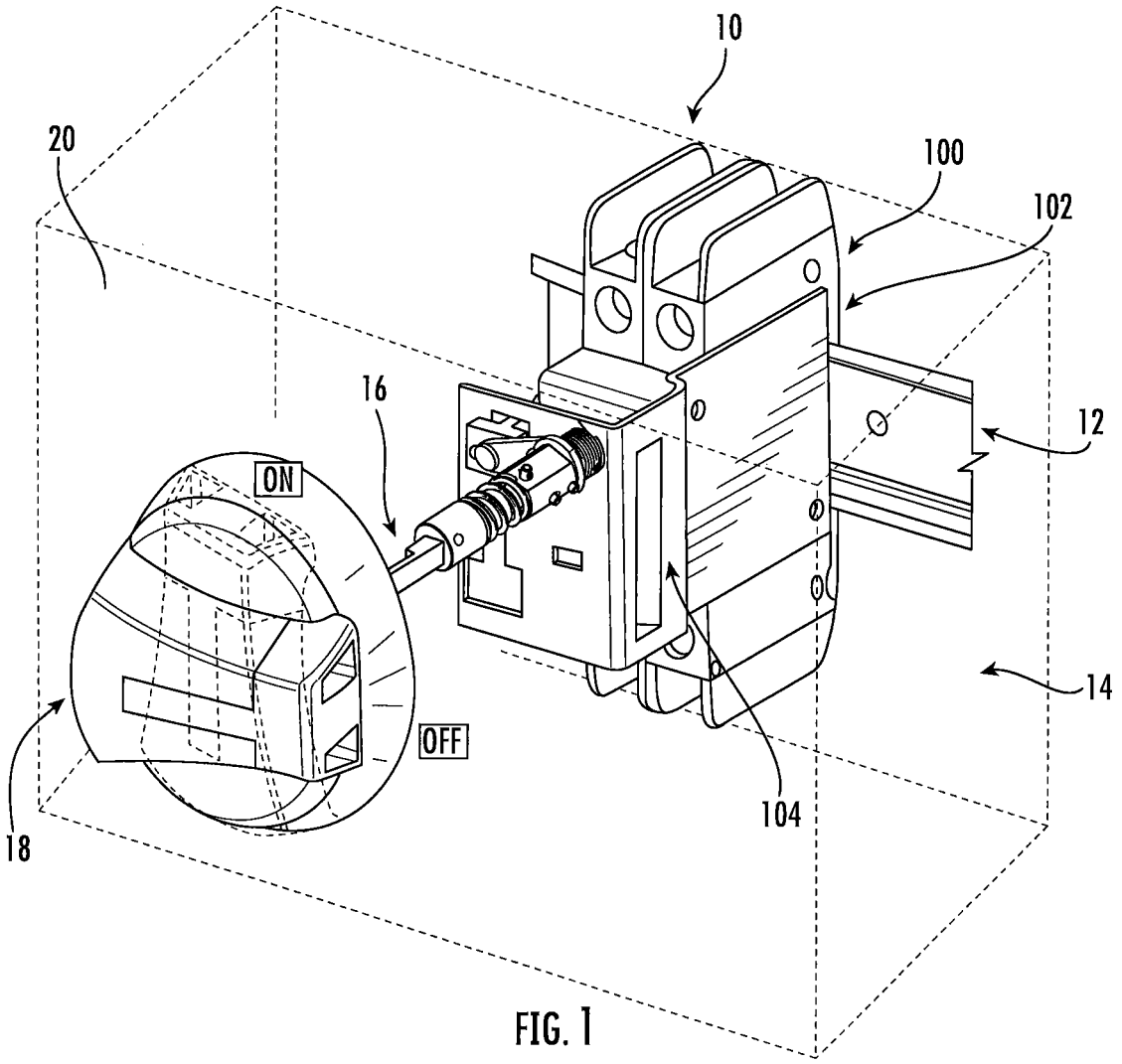
FIG. 1 is a perspective view of a circuit breaker system according to some embodiments of the present invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under," "below," "lower," "over," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises," "comprising," "includes" and/or "including," when used in this specification, specify the presence of stated features, integers, steps, operations, elements, and/or components, but do not preclude the presence or addition of one or more other features, integers, steps, operations, elements, components, and/or groups thereof.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

A circuit breaker system 10 is illustrated in FIG. 1. The system 10 includes a circuit breaker assembly 100. The circuit breaker assembly 100 includes a circuit breaker 102 and a handle mechanism 104 connected to the circuit breaker 102.

The circuit breaker 102 may be mounted on a mounting structure 12 such as a DIN rail and housed within an enclosure or cabinet 14 such as a NEMA box. As described in more detail below, the handle mechanism 104 engages a handle of the circuit breaker 102 and converts linear motion of the handle into rotary motion. The rotary motion is transferred through a shaft 16 extending from the handle mechanism 104 to a rotary handle 18 mounted on a front panel or door 20 of the enclosure 14. Thus, the handle mechanism 104 allows the circuit breaker 102 to be turned on and off from the exterior of the enclosure 14 using the rotary handle 18. In addition, the rotary handle 18 may indicate a trip position by rotating when the circuit breaker 102 trips.

It will be appreciated that the system 10 may include a plurality of the circuit breakers 102 mounted to the DIN rail 12 and a corresponding plurality of the handle mechanisms 104, shafts 16, and rotary handles 18.

Figure 2:
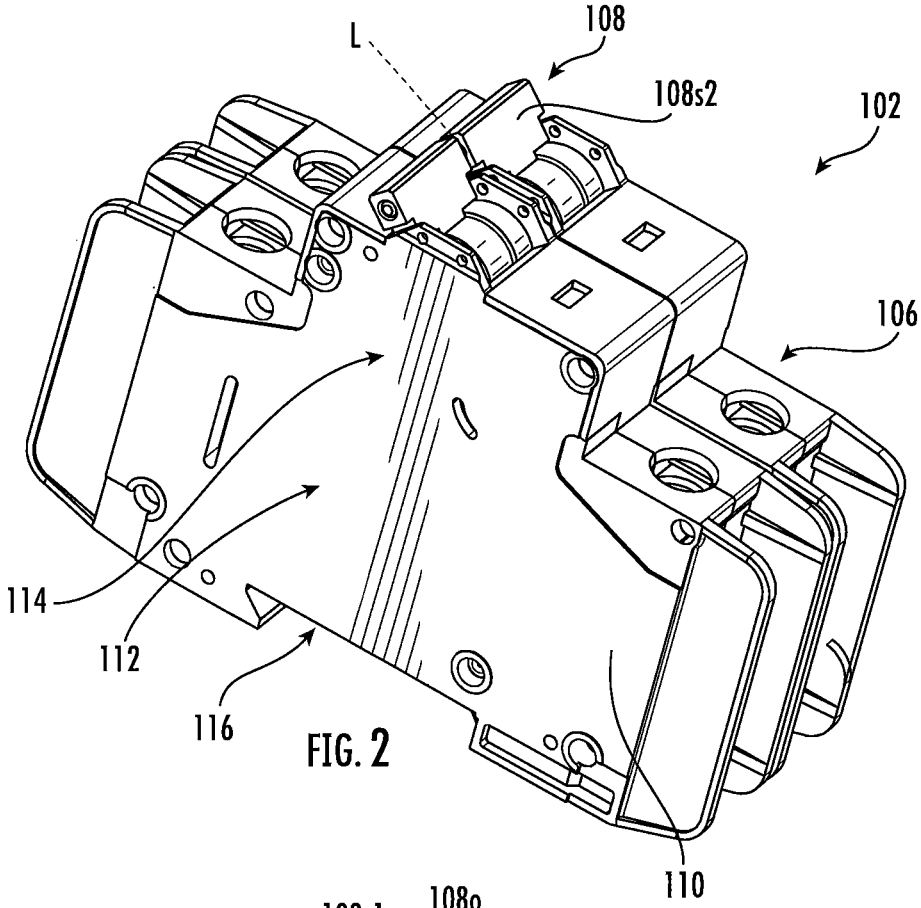
FIG. 2 is a perspective view of a circuit breaker of the system of FIG. 1 with a handle of the circuit breaker in an on position.
Figure 3:
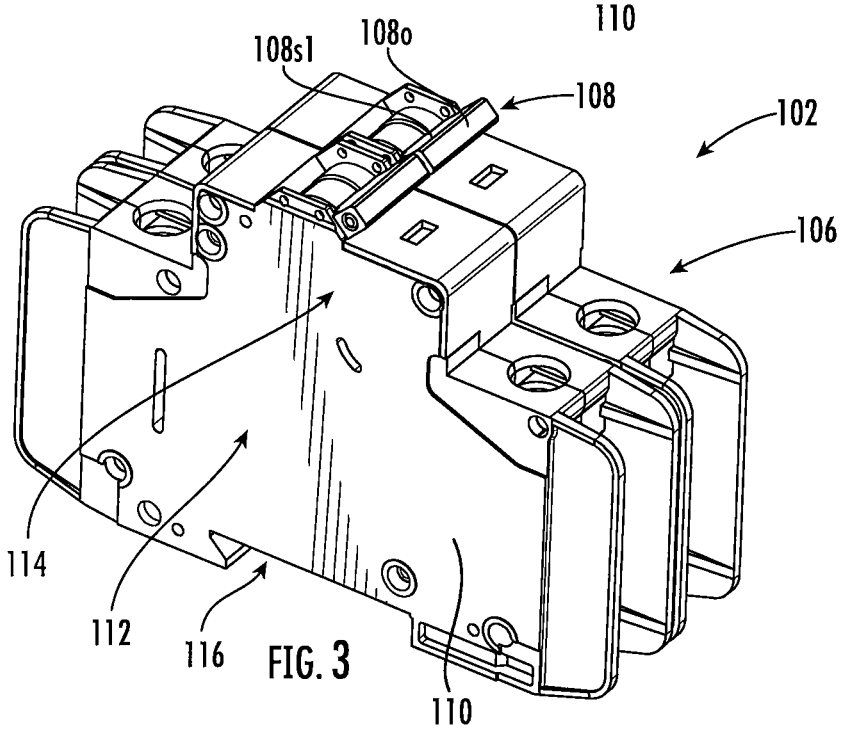
FIG. 3 is a perspective view of the circuit breaker of FIG. 2 with the handle of the circuit breaker in an off position.

Referring to FIGS. 2 and 3, the circuit breaker 102 includes a housing 106 and a handle 108 extending from the housing 106. The housing 106 includes an exterior or outer surface 110. The housing 106 may include a main portion 112 and a protruding portion 114 that extends or protrudes away from the main portion 112. The main portion may include a notch 116 defined therein opposite the protruding portion 114 that is configured to receive the DIN rail 12 to mount the circuit breaker assembly 100 in the NEMA box 14 (FIG. 1).

The handle 108 is movable between an on position (FIG. 2) and an off or tripped position (FIG. 3) to switch the circuit breaker 102 between on and off or tripped states as is well understood in the art. The handle 108 includes an outer surface 108*o* and first and second opposed side surfaces 108*s*1, 108*s*2.

Figure 4:
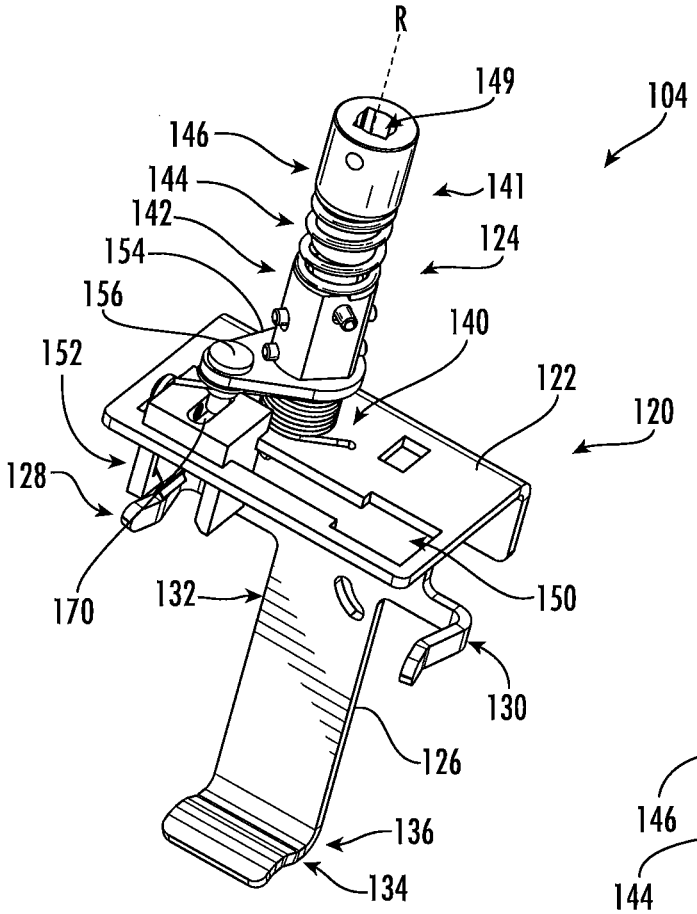
FIG. 4 is a perspective view of a handle mechanism of the system of FIG. 1 according to some embodiments of the present invention.
Figure 5:
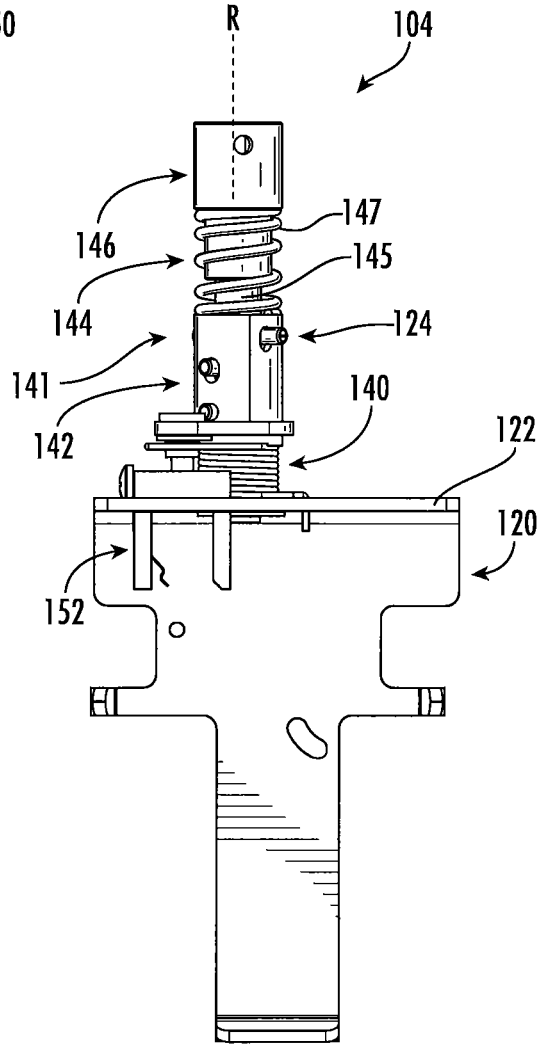
FIG. 5 is a front view of the handle mechanism of FIG. 4.

Referring to FIGS. 4 and 5, the handle mechanism 104 includes a bracket 120 that includes a base 122. The handle mechanism 104 includes a crank assembly 124 coupled to or on the base 122.

The bracket 120 includes an elongated panel 126 that extends away from the base 122. First and second tabs 128, 130 are at a central portion 132 of the panel 126. The first and second tabs 128, 130 are spaced apart and face one another. A third tab 134 is at a distal end portion 136 of the panel 126.

Figure 8:
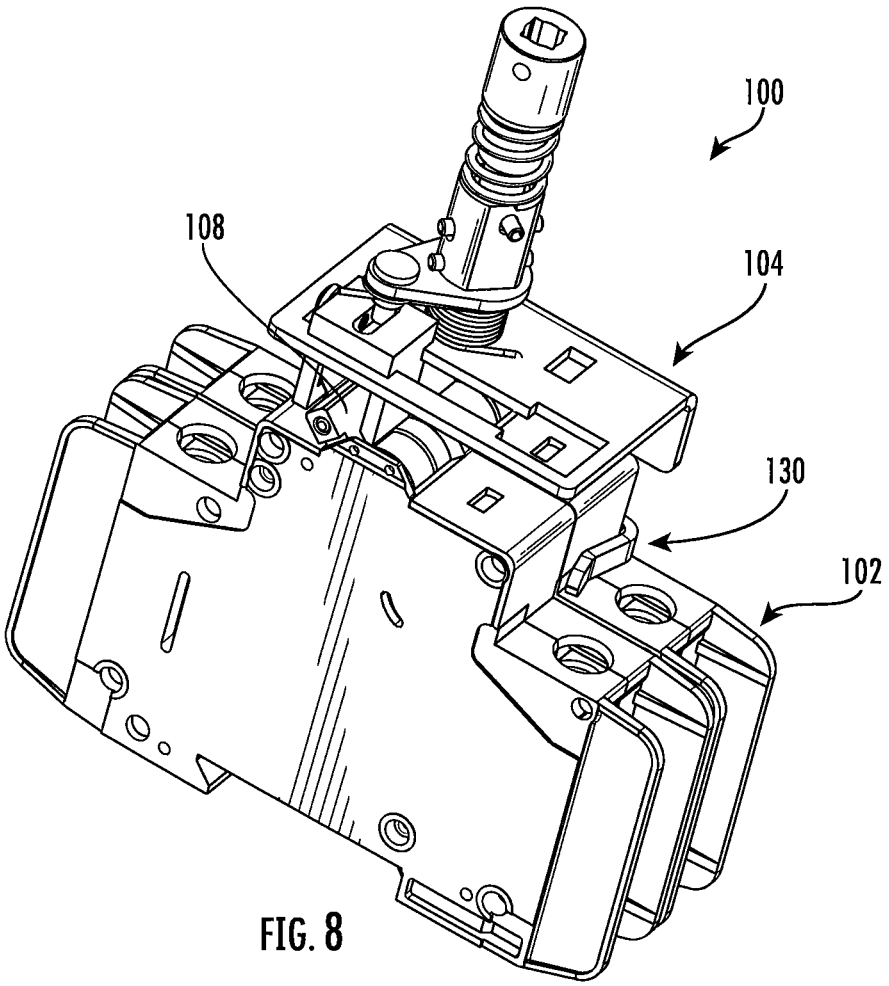
FIG. 8 is a perspective view of a circuit breaker assembly including the circuit breaker of FIG. 2 and the handle mechanism of FIG. 4 according to some embodiments of the present invention.
Figure 9A:
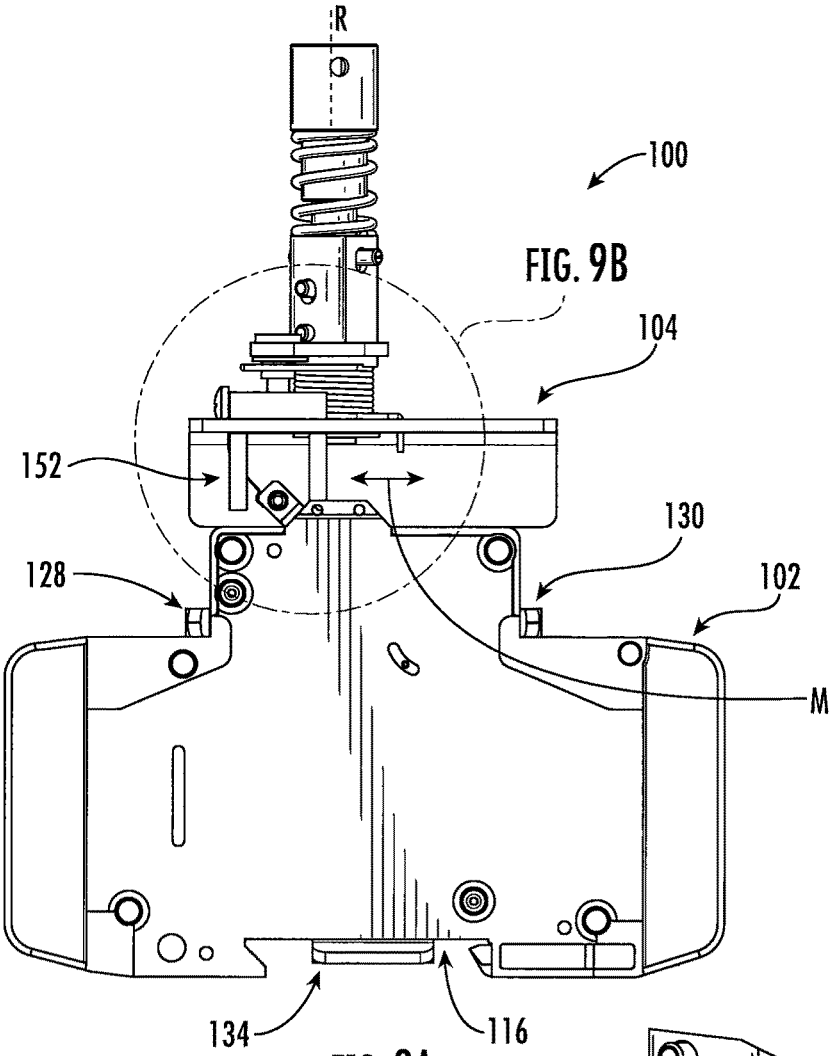
FIG. 9A is a side view of the circuit breaker assembly of FIG. 8 with the circuit breaker handle in the on position.
Figure 10A:
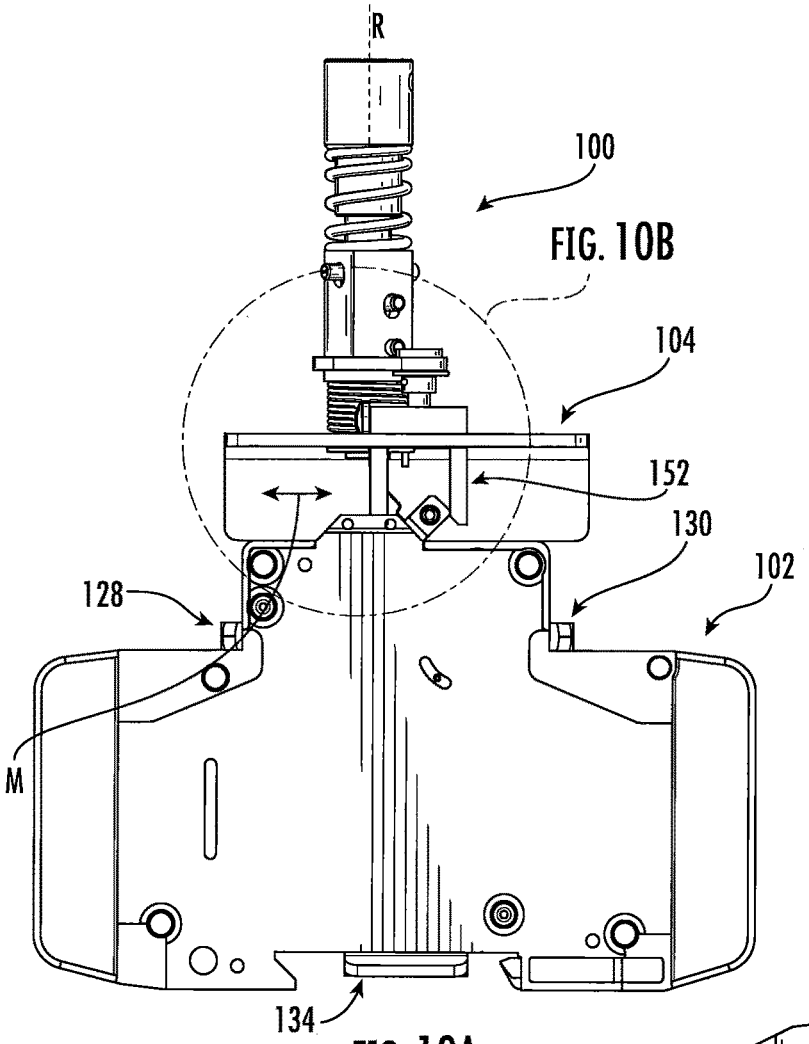
FIG. 10A is a side view of the circuit breaker assembly of FIG. 8 with the circuit breaker handle in the off position.

As can be seen from FIGS. 8, 9A, and 10A, the handle mechanism 104 may be connected to the circuit breaker 102 with the tabs 128, 130, 134 engaging the housing 106 (FIGS. 2 and 3) of the circuit breaker 102. The first and second tabs 128, 130 engage the housing 106 at the intersection of the main portion 112 and the protruding portion 114 and the third tab 134 engages the housing 106 at the notch 116 (FIGS. 2, 3, 9A, and 10A). The tabs 128, 130, 134 are compressively engaged with the housing 106 to help retain the handle mechanism 104 on the circuit breaker 102.

Referring again to FIGS. 4 and 5, the crank assembly 124 includes a return or torsion spring 140 coupled to or on the base 122, a coupler 142, a joint 144, and/or a shaft connector 146. The joint 144 may include a connection bar 145 (which may be flexible and/or resilient) between the coupler 142 and the shaft connector 146 and a compression spring 147 surrounding the connection bar 145. The shaft connector 146 includes a bore or channel 149 configured to receive the shaft 16 (FIG. 1).

The crank assembly 124 includes a rotatable portion 141 that includes the coupler 142, the joint 144, and/or the shaft connector 146.

An elongated slot 150 is defined in the base 122. A slider is 152 is received in the slot 150 and connected to the crank assembly 124 by, for example, a linkage 154 and/or a fastening member 156 that is received through an opening in the slider 152 (see, for example, the opening 170 in FIG. 6).

Figure 6:
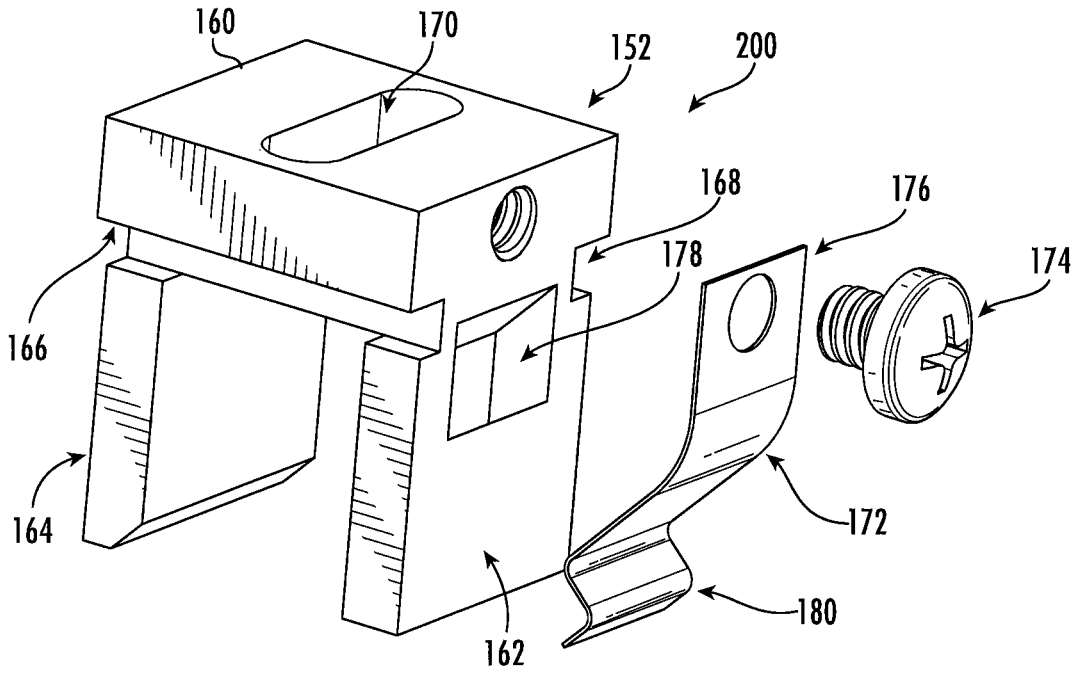
FIG. 6 is an exploded perspective view of a slider of the handle mechanism of FIG. 4 according to some embodiments of the present invention.
Figure 7:
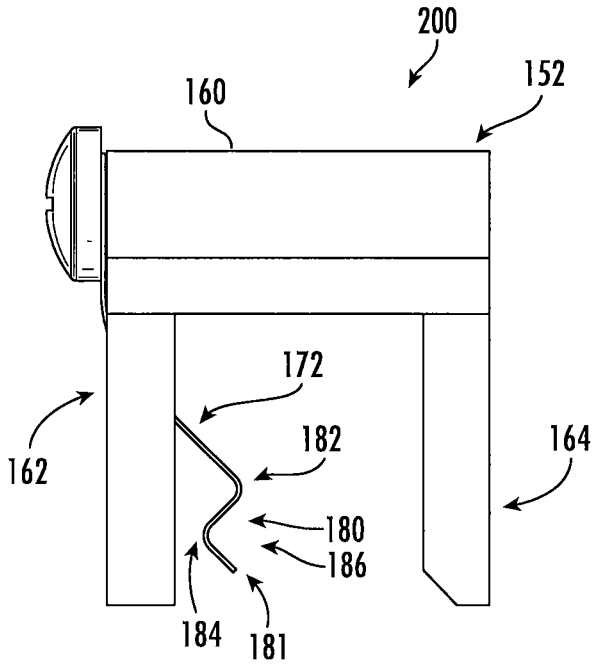
FIG. 7 is an assembled side view of the slider of FIG. 6.

Referring to FIGS. 6 and 7, the slider 152 includes a base 160 and first and second opposed arms 162, 164 extending perpendicularly from the base 160. First and second opposed recesses 166, 168 may be defined between the base 160 and the arms 162, 164. The base 122 of the bracket 120 may be received in the recesses 166, 168 when the slider 152 is received in the slot 150 (FIG. 4).

An opening 170 may be defined in the base 160 of the slider 152. As described above, a fastening member 156 may be received in the opening 170 to connect the slider 152 to the linkage 154 and/or the crank assembly 124 (FIG. 4).

FIGS. 9A and 10A illustrate the handle mechanism 104 connected to the circuit breaker 102. The crank assembly 124 (FIGS. 4 and 5) is rotatable about an axis of rotation R between first and second orientations to move or translate the slider 152 between first and second positions along a movement axis M to switch the circuit breaker 102 between first and second states, respectively.

Figure 9B:
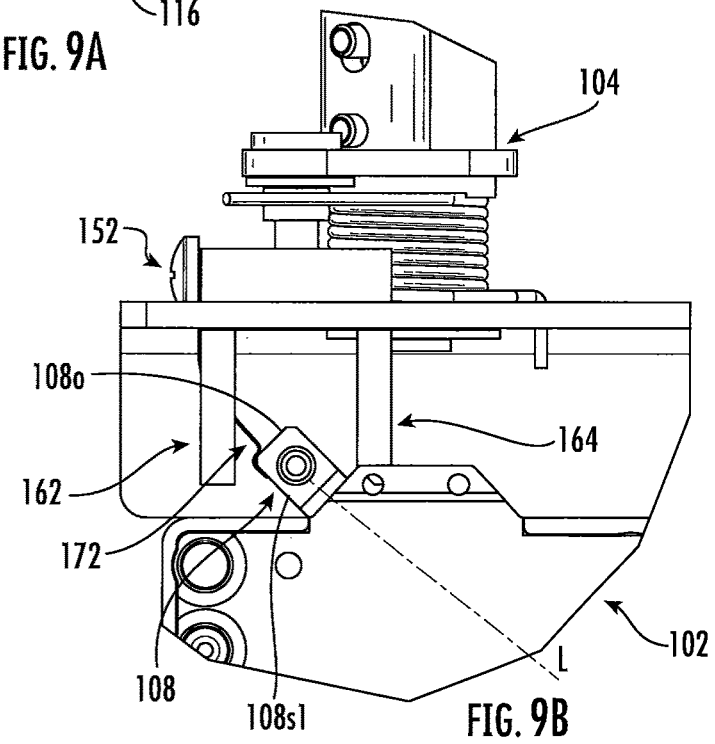
FIG. 9B is a fragmentary side view illustrating detail "FIG. 9B" of FIG. 9A.

More specifically, the handle 108 of the circuit breaker 102 is received between the first and second arms 162, 164 of the slider 152. FIGS. 9A and 9B illustrate the slider 152 in the first position and the handle 108 in the on position. In response to rotation of the crank assembly 124 from the first orientation to the second orientation, the slider 152 moves from the first position shown in FIGS. 9A and 9B to the second position shown in FIGS. 10A and 10B. As a result, the first arm 162 of the slider 152 engages the handle 108 and moves or urges the handle 108 from the on position to the off position.

Figure 10B:
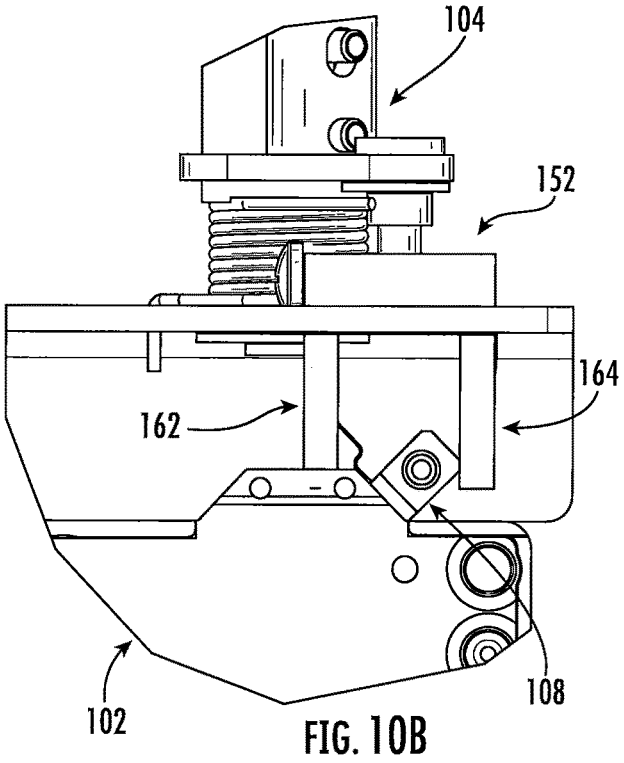
FIG. 10B is a fragmentary side view illustrating detail "FIG. 10B" of FIG. 10A.

In response to rotation of the crank assembly 124 from the second orientation to the first orientation, the slider 152 moves from the second position shown in FIGS. 10A and 10B to the first position shown in FIGS. 9A and 9B. As a result, the second arm 164 of the slider 152 engages the handle 108 and moves or urges the handle 108 from the off position to the on position.

Therefore, it can be seen from FIGS. 1, 9A, and 10A that the rotary handle 18 may be rotated in opposite directions to switch the circuit breaker 102 between the on state and the off or tripped state. Further, if the circuit breaker 102 is in the on state and then trips, the handle 108 engages the second arm 164 of the slider 152 and the slider 152 moves from the first position shown in FIG. 9A to the second position shown in FIG. 10A. In response, the crank assembly 124 rotates from the first orientation to the second orientation and the rotary handle 18 rotates from an on position to an off or tripped position to indicate that the circuit breaker 102 has tripped.

As shown in FIG. 1, the on position and the off position of the rotary handle 18 may be 90° from one another or substantially 90° from one another. Likewise, the first and second orientations of the shaft 16 and/or crank assembly 124 may be 90° from one another or substantially 90° from one another.

Referring again to FIGS. 1, 4, and 5, the joint 144 allows the shaft connector 146 and thus the shaft 16 mounted therein to be movable with respect to the coupler 142 and the base 122 in directions transverse to the axis of rotation R. An access port that is in the front panel 20 of the NEMA box 14 may not be perfectly aligned with the axis of rotation R, and this transverse movement allows for some degree of misalignment.

The return spring 140 rotationally biases the crank assembly 124 toward the off or tripped state of the circuit breaker 102.

The system 10 and the circuit breaker assembly 100 described above are similar to the apparatus described in commonly-owned and co-pending U.S. patent application Ser. No. 15/972,414, filed May 7, 2018, the disclosure of which is hereby incorporated by reference in its entirety.

Referring to FIG. 1, when the circuit breaker 102 trips, the rotary handle 18 should indicate a trip position by rotating to an off position. In order to rotate the shaft 16 and the rotary handle 18, the handle mechanism 104 includes the return spring 140 that "assists" the circuit breaker handle 108 to overcome friction and/or inertia/mass forces of the connecting shaft 16 and the rotary handle 18.

The return spring 140 may have excessive force or tension that can inhibit the circuit breaker handle 108 from remaining latched in the on position. The spring force may need to be fine-tuned to work with two to four pole circuit breakers. Also, the return spring may have excessive force or tension that may cause the circuit breaker to trip from a shock ("shock-off") typical of industrial or hazardous equipment vibration.

The present invention can address these problems by including a spring 172 on the slider 152. The spring 172 engages the circuit breaker handle when the handle is in the on position.

Referring to FIGS. 6 and 7, a slider assembly 200 includes the slider 152 and a spring 172. The spring 172 may be a flat spring (e.g., made of a flat material). The slider assembly 200 may also include a fastening member 174 to fasten the spring 172 to the slider 152. In some other embodiments, the spring 172 may be adhered or welded to the slider 152 or may be integrally formed with the slider 152.

As illustrated, a first end portion 176 of the spring 172 is connected to the base 160 of the slider. An opening 178 is defined in the first arm 162 of the slider 152. The spring 172 extends through the opening 178 such that a second end portion (or free end portion) 180 of the spring 172 is between the first and second arms 162, 164 of the slider 152. The spring 172 includes a free end 181 that may be closer to the first arm 162 than the second arm 164 of the slider.

The second end portion 180 and the free end 181 of the spring 172 are spaced apart from the first arm 162 of the slider 152. The second end portion 180 of the spring 172 includes first and second bends 182, 184 such that the second end portion 180 of the spring 172 includes a shaped seat 186. The seat 186 may be L-shaped or S-shaped.

Referring to FIG. 9B, with the handle 108 in the on position, the second end portion 180 of the spring 172 engages the handle 108. The handle 108 may be received in the seat 186 such that the spring 172 engages the handle outer surface **108*o* and one of the handle side surfaces such as the side surface 108*s*1**.

With the configuration as shown in FIG. 9B, the spring 172 transmits the force from the return spring 140 in a direction that is coaxial or substantially coaxial, or that is parallel or substantially parallel, to a longitudinal axis L of the handle 108. In other words, the transmitted force is perpendicular or substantially perpendicular to the outer surface **108*o* of the circuit breaker handle 108. As a result, excess force from the return spring 140 does not trip the circuit breaker 102. The circuit breaker 102 can only trip electrically or by manual movement of the external handle 18 (FIG. 1**).

In some embodiments, as used herein, the term "substantially" when used in connection with a claimed angular relationship includes angles that are ±5° of the claimed angular relationship. In some other embodiments, as used herein, the term "substantially" when used in connection with a claimed angular relationship includes angles that are ±10° of the claimed angular relationship.

If the circuit breaker 102 is turned off manually, the (resilient flat) spring 172 flexes and releases from the handle 108. If the spring design was a solid shape (e.g., not resilient and/or not spaced apart from the first arm 162 of the slider 152), the return force would remain substantially along or parallel to the handle longitudinal axis L and the breaker could not be turned off manually.

The design with the spring 172 allows for more variation of the return spring 140 force, thereby eliminating the need to fine tune the return spring 140 (e.g., for different circuit breakers or different number of poles). The design with the spring 172 also allows the return spring to be "stiffer" (e.g., have a larger return force) without nuisance tripping. The stiffer return spring also provides consistent rotation of the rotary handle 18 to the off position (FIG. 1).

In some embodiments, with the slider 152 in the second position (FIGS. 10A and 10B), the spring 172 is spaced apart from the circuit breaker handle 108. In some other embodiments, with the slider 152 in the second position (FIGS. 10A and 10B), the free end 181 of the spring 172 (FIG. 7) engages the circuit breaker handle 108.

The foregoing is illustrative of the present invention and is not to be construed as limiting thereof. Although a few example embodiments of this invention have been described, those skilled in the art will readily appreciate that many modifications are possible in the example embodiments without materially departing from the teachings and advantages of this invention. Accordingly, all such modifications are intended to be included within the scope of this invention as defined in the claims. The invention is defined by the following claims, with equivalents of the claims to be included therein.

The invention claimed is:

1. A circuit breaker assembly comprising:

a circuit breaker comprising a housing and a handle extending from the housing, the handle movable between an on position and an off position;

a handle mechanism connected to the housing of the circuit breaker, the handle mechanism comprising:

a base;

a slider slidably connected to the base and comprising first and second spaced apart arms with the handle of the circuit breaker at least partially received between the first and second arms, the slider movable between a first position with the handle in the on position and a second position with the handle in the off position; and a spring on the slider, wherein the handle engages the spring with the handle in the on position and the slider in the first position.

2. The assembly of claim 1 wherein:

the spring is a flat spring comprising first and second opposite end portions; and the first end portion is connected to the slider and the second end portion comprises a free end and is spaced apart from the first arm of the slider.

3. The assembly of claim 2 wherein:

an opening is defined in the first arm of the slider; and the spring extends through the opening such that the second end portion of the spring is between the first arm and the second arm of the slider.

4. The assembly of claim 2 wherein:

the second end portion comprises at least one bend such that the second end portion includes an L-shaped seat; and the handle is received in the L-shaped seat with the handle in the on position and the slider in the first position.

5. The assembly of claim 1 wherein the handle mechanism comprises a crank assembly connected to the base, the crank assembly comprising:

a rotatable portion configured to receive a shaft; and a linkage connecting the rotatable portion and the slider;

wherein the crank assembly is configured to convert rotational motion of the shaft to linear motion of the slider and to convert linear motion of the slider to rotational motion of the shaft.

6. The assembly of claim 5 wherein the crank assembly comprises a return spring between the rotatable portion and the base, the return spring configured to bias the slider toward the second position.

7. The assembly of claim 6 wherein, with the handle in the on position and the slider in the first position, the spring on the slider is configured to transmit force from the return spring to the handle of the circuit breaker in a direction that is substantially coaxial to or substantially parallel to a longitudinal axis of the handle.

8. The assembly of claim 5 wherein the spring is resilient and configured to deflect toward the first arm in response to rotational motion of the shaft.

9. The assembly of claim 1 wherein the handle is spaced apart from the spring with the handle in the off position and the slider in the second position.

10. A method for operating a circuit breaker system, the method comprising:

providing the circuit breaker system comprising:

a circuit breaker comprising a housing and a handle extending from the housing, the handle movable between an on position and an off position;

a handle mechanism connected to the housing of the circuit breaker, the handle mechanism comprising:

a bracket comprising a base;

a slider on the base, the slider comprising first and second spaced apart arms with the handle at least partially received between the arms, the slider being slidable along the base between a first position with the handle in the on position and a second position with the handle in the off position; and a spring on the slider extending between the first and second arms;

receiving the handle against the spring with the slider in the first position and the handle in the on position; and using the spring, transmitting a force to the handle of the circuit breaker in a direction that is substantially coaxial to or substantially parallel to a longitudinal axis of the handle so as to prevent the slider from inadvertently moving from the first position to the second position.

11. The method of claim 10 wherein:

the handle mechanism further comprises a crank assembly comprising a return spring that provides a return force to bias the slider toward the second position; and transmitting the force to the handle of the circuit breaker comprises transmitting the return force.

12. The method of claim 10 wherein transmitting the force to the handle of the circuit breaker comprises transmitting force associated with a vibration or shock.

13. The method of claim 10 wherein:

the handle mechanism further comprises a crank assembly with the slider operatively connected to the crank assembly;

the circuit breaker system further comprises:

an enclosure with the circuit breaker held in the enclosure;

a rotary handle on the enclosure; and a shaft extending between the crank assembly and the rotary handle; and the method further comprises, in response to rotating the rotary handle from a first orientation to a second orientation, moving the slider from the first position to the second position to thereby move the handle from the on position to the off position.

14. The method of claim 13 further comprising deflecting the spring toward the first arm in response to rotating the rotary handle from the first orientation to the second orientation.

15. The method of claim 10 further comprising:

moving the handle from the on position to the off position in response to an electrical trip of the circuit breaker; and urging the slider from the first position to the second position by engaging the second arm with the handle in response to moving the handle from the on position to the off position.

16. A circuit breaker system comprising:

an enclosure;

a circuit breaker held in the enclosure, the circuit breaker comprising a housing and a handle extending from the housing, the handle movable between an on position and an off position;

a handle mechanism connected to the housing of the circuit breaker, the handle mechanism comprising:

a bracket comprising a base;

a crank assembly on the base;

a slider connected to the base and operatively connected to the crank assembly, the slider comprising first and second spaced apart arms with the handle of the circuit breaker at least partially received between the first and second arms, the slider configured to slide between a first position with the handle in the on position and a second position with the handle in the off position; and a spring comprising an L-shaped seat on the slider;

a rotary handle on the enclosure; and a shaft extending between the crank assembly and the rotary handle;

wherein the slider is configured to move between the first position and the second position in response to rotation of the rotary handle between a first orientation and a second orientation;

wherein the handle engages and is received in the L-shaped seat of the spring with the handle in the on position and the slider in the first position.

17. The system of claim 16 wherein:

the crank assembly comprises a return spring that is configured to bias the slider toward the second position; and with the handle in the on position and the slider in the first position, the spring on the slider is configured to transmit force from the return spring to the handle of the circuit breaker in a direction that is substantially coaxial to or substantially parallel to a longitudinal axis of the handle.

18. The system of claim 16 wherein the crank assembly is configured to rotate the rotary handle from the first orientation to the second orientation in response to the circuit breaker switching from an on state to a tripped state.

19. The system of claim 16 wherein the spring is resilient and configured to deflect toward the first arm in response to rotation of the rotary handle from first orientation to the second orientation.

20. The method of claim 10 wherein:

the spring is a flat spring comprising first and second opposite end portions, the first end portion is connected to the slider and the second end portion comprises a free end and is spaced apart from the first arm of the slider, the second end portion comprises at least one bend such that the second end portion includes an L-shaped seat, and receiving the handle against the spring comprises receiving the handle in the L-shaped seat.

* * * * *